US006543553B2

(12) United States Patent
Bergeron

(10) Patent No.: US 6,543,553 B2
(45) Date of Patent: Apr. 8, 2003

(54) APPARATUS FOR USE IN DRILLING OIL AND GAS PRODUCTION WELLS OR WATER INJECTION WELLS

(75) Inventor: Henry Anthony Bergeron, Houston, TX (US)

(73) Assignee: Chevron Nigeria Limited, Lagos (NG)

( * ) Notice: Subject to any disclaimer, the term of this patent is extended or adjusted under 35 U.S.C. 154(b) by 0 days.

(21) Appl. No.: 09/772,818

(22) Filed: Jan. 29, 2001

(65) Prior Publication Data

US 2002/0100614 A1 Aug. 1, 2002

(51) Int. Cl.[7] ..... E21B 7/08

(52) U.S. Cl. ..... 175/61; 175/74; 166/313

(58) Field of Search ..... 175/61, 62, 73, 175/74, 75, 78, 79, 81, 82, 76; 166/50, 313

(56) References Cited

U.S. PATENT DOCUMENTS

| | | | |
|---|---|---|---|
| 2,211,803 | A | 8/1940 | Warburton |
| 2,492,079 | A | 12/1949 | Wiley |
| 3,083,768 | A | 4/1963 | Althouse, Jr. et al. |

(List continued on next page.)

FOREIGN PATENT DOCUMENTS

| | | |
|---|---|---|
| EP | 0 310 215 | 5/1989 |

OTHER PUBLICATIONS

Njaerheim, A. et al., "New well design in the Statfjord field utilizing a multi–lateral well in low productive zones in the Brent reservoir," Proceedings of the IADC/SPE Asia Pacific Drilling Technology Conference, APDT 1998. Soc Pet Eng, pp. 547–558.

Giagniacomo, Leo A et al., "A proven procedure for squeezing an openhole window in a deviated cased wellbore," Rocky Mountain Regional/Low Permeability Reservoirs Symposium and Exhibition 1997, Soc Pet Eng, pp. 161–170.

Dickinson, W., et al., "Slim hole multiple radials drilled with coiled tubing" 2nd SPE Latin American Petroleum Engineering Conference, Mar. 1992, Proc. V 2, pp. 131–139.

Maddox, S. D., Application of downhole video technology to multilateral well completions, International Oil & Gas Conference and Exhibition in China, Nov. 2, 1998, Soc Pet Eng, vol. 1, pp. 35–40.

Aloko. J. A. et al., "Africa's first dual horizontal/dual completion multilateral well", Sixth International Oil & Gas Conference and Exhibition in China, Nov. 1998, Soc Pet Eng, vol. 1, pp. 151–163.

Hall. J. et al., "Slickline power unit on coiled tubing provides innovative solution for setting a nippleless lock in a multilateral completion," Asia Pacific Drilling Technology Conference, Sep. 7, 1998, Soc Pet Eng, pp. 387–400.

Freeman. A., et al., "First successful multilateral well installation from a floating rig: development and case history", SPE Drilling Conference, Mar. 3, 1998, Soc Pet Eng, pp. 647–658.

Antczak. E. J., et al., "Implementation of an advanced multi–lateral system with coiled tubing accessibility," IADC drilling conference Mar. 4, 1977, Soc Pet Eng, pp. 869–877.

Hovda. S., et al., "World's first application of a multilateral system combining a cased and cemented junction with fullbore access to both laterals," European Petroleum Conference, Oct. 22, 1996, Soc Pet Eng, pp. 15–29.

*Primary Examiner*—Frank S. Tsay
(74) *Attorney, Agent, or Firm*—Richard J. Schulte

(57) ABSTRACT

An apparatus and method for drilling two separate and independent wellbores through a single surface casing. According to one aspect of the invention, a drilling assembly guides a drill bit into one of two different directions through the use of a removable guide. In order to change wellbores, the removable guide is rotated which can be performed in a one step operation.

26 Claims, 9 Drawing Sheets

U.S. PATENT DOCUMENTS

| | | | | | |
|---|---|---|---|---|---|
| 3,330,349 | A | | 7/1967 | Owsley et al. | |
| 3,842,912 | A | | 10/1974 | Lindsey, Jr. | |
| 4,396,075 | A | * | 8/1983 | Wood et al. | 175/79 |
| 4,415,205 | A | * | 11/1983 | Rehm et al. | 299/5 |
| 4,420,049 | A | * | 12/1983 | Holbert | 175/45 |
| 4,432,422 | A | | 2/1984 | Hopley et al. | |
| 4,508,166 | A | | 4/1985 | Becker et al. | |
| 4,573,541 | A | | 3/1986 | Josse et al. | |
| 4,807,704 | A | | 2/1989 | Hsu et al. | |
| 5,330,007 | A | | 7/1994 | Collins et al. | |
| 5,377,762 | A | | 1/1995 | Turner | |
| 5,458,199 | A | | 10/1995 | Collins et al. | |
| 5,462,120 | A | | 10/1995 | Gondouin | |
| 5,560,435 | A | | 10/1996 | Sharp | |
| 5,655,602 | A | | 8/1997 | Collins | |
| 5,685,373 | A | | 11/1997 | Collins et al. | |
| 5,704,437 | A | | 1/1998 | Murray | |
| 5,806,614 | A | | 9/1998 | Nelson | |
| 5,878,815 | A | | 3/1999 | Collins | |
| 5,884,698 | A | | 3/1999 | Hughes et al. | |
| 5,960,873 | A | | 10/1999 | Alexander et al. | |
| 5,964,287 | A | | 10/1999 | Brooks | |
| 6,009,942 | A | | 1/2000 | Williamson | |
| 6,053,254 | A | | 4/2000 | Gano | |
| 6,056,059 | A | * | 5/2000 | Ohmer | 166/313 |
| 6,123,150 | A | | 9/2000 | McGarian et al. | |
| 6,135,208 | A | | 10/2000 | Gano et al. | |

* cited by examiner

APPARATUS FOR USE IN DRILLING OIL AND GAS PRODUCTION WELLS OR WATER INJECTION WELLS

FIELD OF THE INVENTION

The invention relates to an apparatus and method for use in drilling oil and gas production wells or water injection wells, and more particularly, provides technology which allows two separate and independent wellbores to be drilled through the same wellbore.

BACKGROUND OF THE INVENTION AND BRIEF

DESCRIPTION OF THE RELATED ART

Generally, oil and gas production wells and water injection wells are drilled through a large diameter surface structural pipe. As the wellbore gets deeper, changes in water salinity, rock strength and pore fluid characteristics may require additional smaller support casing strings to be installed inside the structural pipe. These additional smaller support casing strings are known as the conductor casing, surface casing and intermediate casing strings. Smaller and smaller casing strings are installed at increasing depth until the rock formation of interest is penetrated and cased with the final production casing. The casing strings are supported by cement. The production casing supplies a conduit for the production tubing through which well fluid flows and maintains the well integrity by keeping the well fluids from escaping. Meanwhile, the inner support casing strings are necessary to the drilling of the well but serve no function after drilling is completed.

As a result of the increased cost of drilling wells into deeper subterranean formations, wellbores are being drilled into formations and orientations by both horizontal and deviated drilling technology. Although horizontal and deviated wells are more expensive than the conventional vertical well, the increased production of hydrocarbons from the subterranean formation can offset the increased costs. Horizontal and deviated wells are especially common on offshore drilling platforms, where the increased production of hydrocarbons from the subterranean formation can be accomplished with fewer platforms by the use of either a horizontal and/or deviated well.

The offshore drilling platforms which are utilized in deep water to drill and complete wells vary in size, structure, and cost depending upon the water depth and the loads in which the platform will be set. In order to reduce the cost of hydrocarbon recovery, multiple wellbores are being drilled through a single surface location involving extra large surface structural pipes through which two casing strings can be run side by side. Although, substantial savings are achieved by drilling two wellbores from a single surface casing, the surface structural pipe in which the two casing strings are run side by side has to be extremely large.

It would be highly desirable to drill two separate and independent wellbores through the same conductor, surface or intermediate casing, thereby saving the duplicate expense of installing the above casing. One way to achieve two separate and independent wellbores is by installation of a drilling assembly which guides the drill bit into one of two different directions, such that two separate wellbores can be drilled into different formations or hydrocarbon zones.

Whipstocks have been used in drilling duplicate wellbores and in order to deviate the wellbore from an essentially vertical course to a desired inclination. A whipstock typically includes tapered sections of round, solid bars which are placed in the wellbore at the desired depth and aligned in the desired direction. The whipstock is typically anchored by a slip mechanism, and used to guide the wellbore tools in a selected direction. The drill bit is guided by the whipstock and mills a window through the casing at the desired location. A second wellbore is then drilled through the casing to the desired formation. When only one deviated borehole is drilled, the whipstock is left in the wellbore to act as a guide for working the well. However, when two or more deviated wellbores are to be drilled from a single wellbore, it is necessary to remove the whipstock. After removal of the whipstock, a re-entry into any of the deviated bore holes is difficult and costly since the whipstock must be placed in the exact location for re-entry.

Another technique for drilling multiple wells through a single casing as disclosed in Gano, et al., U.S. Pat. No. 6,135,208, is through the utilization of a pipe which collapses within its diameter. An expandable wellbore connector is utilized in interconnecting multiple wellbores in the well. The wellbore connector is expanded into a cavity formed in one wellbore, and then another wellbore is drilled through the wellbore connector. The wellbore connector is sealingly engaged with the tubular members in each wellbore.

U.S. Pat. Nos. 5,330,007; 5,458,199; 5,655,602; and 5,685,373 issued to Collins, et al., are all related to a template, and a process utilizing the template, for drilling and completing multilateral wells. The template comprises a body having a first end face, a second end face and a plurality of axially extending divergent bores which extend through the body in intersection with the end faces. The template is secured to a first casing, which extends from the surface to a predetermined depth beneath the surface, or is located at or near the ground surface. A first subterranean borehole is drilled through one of the bores in the template and a first length of production casing is secured to the template such that it extends into the first borehole. Similarly, further subterranean boreholes may be drilled through the further bores in the template and further lengths of production casing may be secured to the template such that the casing extends into its respective borehole.

The Collins, et al. patents describe a conventional tubular riser used to select one of the boreholes. The tubular riser is lowered within the surface casing until the riser is positioned within the first borehole. After drilling the first borehole, the riser is then withdrawn from the bore, rotated, and inserted into a second bore hole. Alternatively, the Collins et al. patents disclose a riser with an orientation cam. The riser and orientation cam is lowered within the casing until a cam key contacts a first slot in the external surface of the cam to orient the rise with the first borehole for drilling the first bore. The riser is then raised from the surface and rotated which causes the riser and cam key to rotate until the key is positioned within a second slot and orientation of the riser in a second borehole is obtained. The second bore is then drilled.

All of these techniques are time consuming, complex and require numerous preparation steps such as under-reaming the wellbore, milling windows in the casing, requiring stats-in inner string cementing equipment or reforming a tube downhole.

Accordingly, it would be desirable to provide an apparatus and method for drilling two separate and independent wellbores through a single surface casing wherein the drill bit can be guided into one of two different directions through the use of a removable guide, and changing wellbores only requires latching the removable guide and rotating the removable guide, which can be performed in a one step operation.

SUMMARY OF THE INVENTION

The present invention provides an efficient solution to drilling two separate and independent bore holes through the same surface or conductor casing. The system includes a drilling assembly, a removable guide, and a latching tool.

In accordance with one aspect of the present invention, an apparatus for use in drilling oil and gas production wells or water injection wells includes a drilling assembly having a first end, a second end, and an adapter located in the drilling assembly between the first end and the second end; at least two tubes extending from the adapter, the tubes forming a first leg for drilling a first bore hole and a second leg for drilling a second bore hole; and a removable guide having a first end and a second end, the first end having an angled surface positioned within the guide to direct a drill bit into one of the legs, and the second end configured to engage the adapter in two positions for directing the drill bit into one of the legs.

In accordance with another aspect of the present invention, a removable guide for use with a drilling assembly includes a tubular body having a first end and a second end, the first end having an angled interior surface positioned within the guide to direct a drill bit into one leg of a drilling assembly, and the second end having members configured to engage an adapter in two positions for directing a drill bit into one of two legs of the drilling assembly.

In accordance with another aspect of the present invention, a system for use in drilling oil and gas production wells or water injection wells includes a drilling assembly having a first end, a second end, and an adapter located in the drilling assembly between the first end and the second end; at least two tubes extending from the adapter, the tubes forming a first leg for drilling a first bore hole and a second leg for drilling a second bore hole; a removable guide having a first end and a second end, the first end having an angled surface positioned within the guide to direct a drill bit into one of the legs, and the second end configured to engage the adapter in two positions for directing the drill bit into one of the legs, and a cylindrical body which surrounds the removable guide, the cylindrical body having an outside diameter and an inside diameter wherein the inside diameter has a slot; and a latching tool having a first end and a second end, the first end having a series of threads to attach to a drilling string, and the second end configured to removably engage the slot in the cylindrical body of the removable guide.

In accordance with a further aspect of the present invention, a method of using a drilling assembly includes the steps of drilling a hole to a desired depth; positioning a removable guide in the drilling assembly for directing a drill bit into a first leg of the drilling assembly; securing the drilling assembly to a casing string; cementing the drilling assembly into the surface hole; and drilling a first wellbore through the first leg of the drilling assembly to a desired depth.

In accordance with another aspect of the present invention, a method of using a drilling assembly includes the steps of drilling a hole to a desired depth; securing the drilling assembly having a first and a second leg to a casing string; cementing the drilling assembly into the hole; drilling a first wellbore through the first leg of the drilling assembly to a desired depth drilling; and drilling a second wellbore through the second leg of the drilling assembly to a second desired depth without the use of a movable guide to direct a drill bit into the second leg of the drilling assembly.

The present invention provides advantages of drilling two separate and independent wellbores through the same conductor, surface or intermediate casing, thereby saving expense, and changing wellbores only requires latching the removable guide and rotating the removable guide, which can be performed in a one step operation.

BRIEF DESCRIPTION OF THE DRAWINGS

The invention will now be described in greater detail with reference to the preferred embodiments illustrated in the accompanying drawings, in which like elements bear like reference numerals, and wherein.

DETAILED DESCRIPTION OF THE PREFERRED EMBODIMENTS

The apparatus and method according to the present invention provide technology for drilling two separate and independent wellbores through a single surface casing. The drill assembly guides the drill bit into one of two different directions through the use of a removable guide. In order to change wellbores, the removable guide is rotated, which can be performed in a one step operation.

The drilling assembly is designed to allow two separate and independent wellbores to be drilled through the same conductor, surface or intermediate casing, thereby saving the duplicate expense of installing the above casing. The drilling assembly is a permanent installation and is installed on the end of the casing string before the production string.

Figure 1:
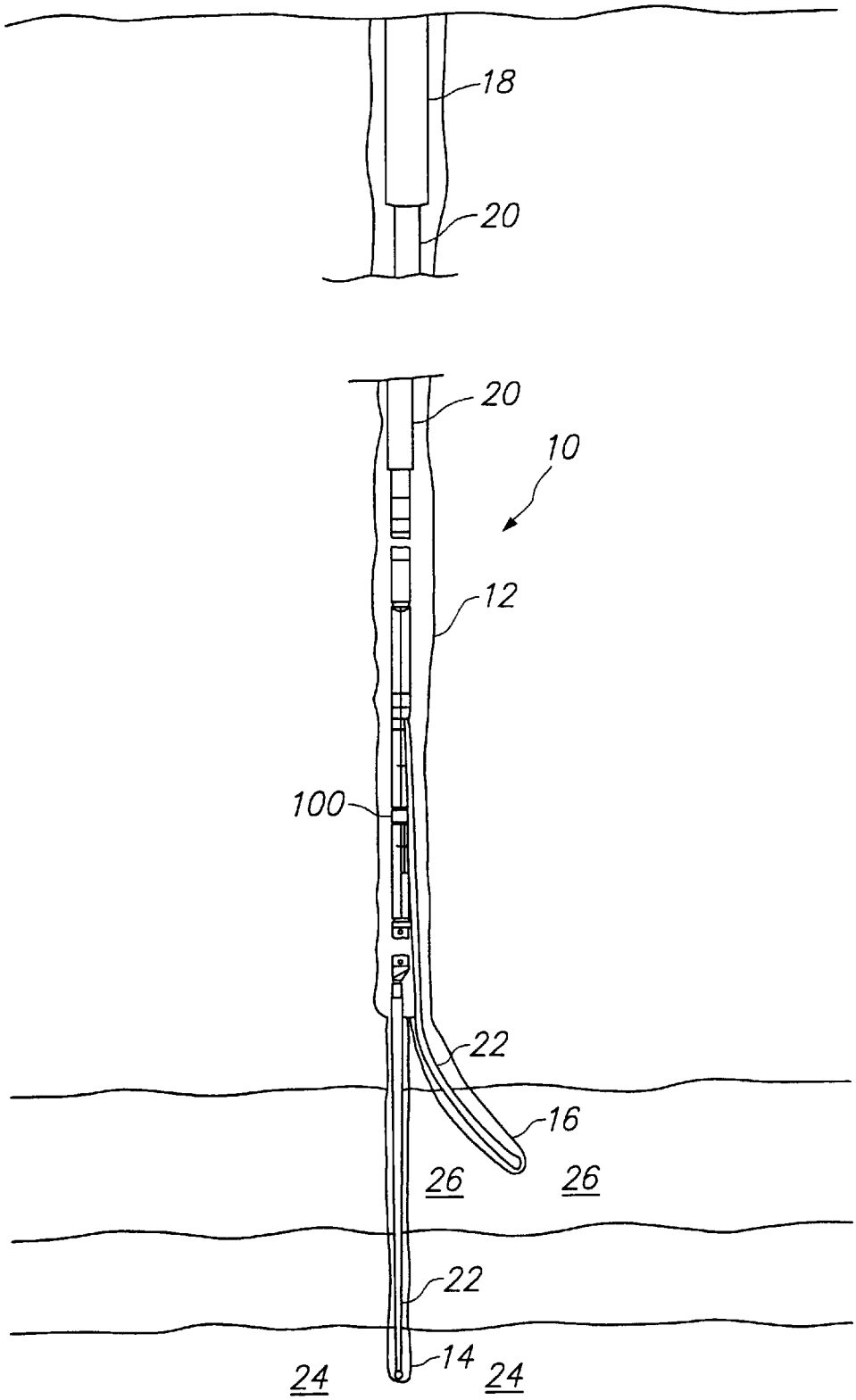
FIG. 1 is a schematic view of a drilling assembly in a wellbore according to the present invention.

FIG. 1 illustrates an apparatus 10 for use in drilling oil and gas production wells or water injection wells. The apparatus 10 includes a drilling assembly 100 which permits two separate and independent wellbores 14, 16 to be drilled from a single wellbore 12 through the same conductor 18, and surface or intermediate casing 20. The drilling assembly 100 is installed on the end of the casing string 20, before the production casing 22 is set. The drilling assembly 100 guides the drill bit into one of two bore holes, such that two wellbores 14, 16 can be drilled into different formations or hydrocarbon zones 24, 26.

Figure 2:
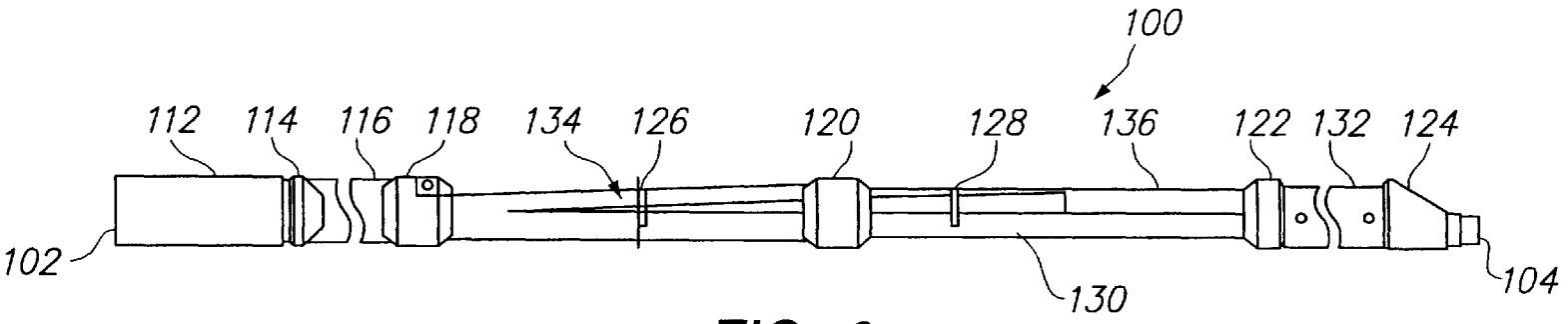
FIG. 2 is a front side view of the drilling assembly.

FIGS. 1–29 illustrate a first embodiment of an apparatus 10 for use in drilling two separate and independent wellbores 14, 16 from a single wellbore 12. As shown in FIG. 2, the drilling assembly 100 has a first end 102, a second end 104, and an adapter 160 (FIG. 9) located in the drilling assembly between the first end and the second end. The drilling assembly 100 includes at least two tubes 130, 134 to form a first leg 130 for drilling a first bore hole and a second leg 134 for drilling a second bore hole. The first and second legs 130, 134 form an angle of about 0 to about 10 degrees, preferably about 0 to about 4 degrees.

The drilling assembly 100 also includes a threaded cylinder 112 which is connected to a receiver guide 114 at the top of the drilling assembly 100. The receiver guide 114 is connected by the two tubes 130 and 134 to an isolation adapter 118. The drilling assembly 100 has an upper centralizer body 120, a middle centralizer body 122, and a lower centralizer body 124 for supporting the drilling assembly in the center of the wellbore and connecting the two tubes 130 and 134.

Figure 3:
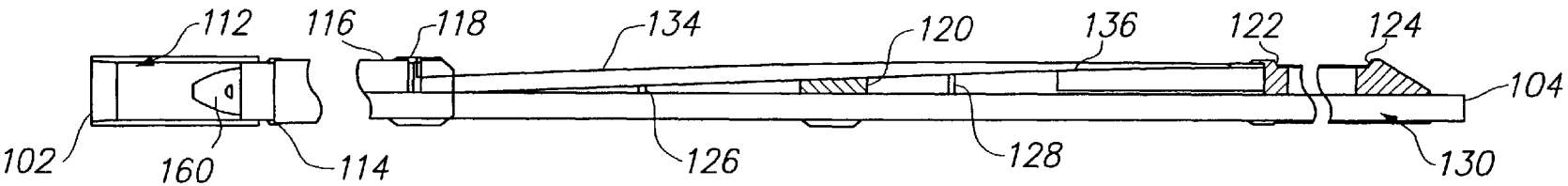
FIG. 3 is a cross-sectional view of the drilling assembly of FIG. 2.

As illustrated in FIGS. 2 and 3, the second leg 134 exits the drilling assembly 100 between the upper centralizer body 120, and middle centralizer body 122 at a side exit 136. The first leg 130 runs the entire length of the drilling assembly 100 and exits at the second end 104. Two supports 126, 128 are located between the isolation adapter 118 and the upper centralizer body 120, and between the upper centralizer body 120 and the middle centralizer body 122, respectively. In addition, at least two tubular supports, 116 and 132, are positioned along the drilling assembly 100 to add support to the drilling assembly as it is lowered into the wellbore.

FIG. 3 is a cross-sectional view of the drilling assembly 100, showing the adapter 160 located within the threaded cylinder 112. The adapter 160 is located between the first end 102 and the isolation adapter 118.

Figure 4:
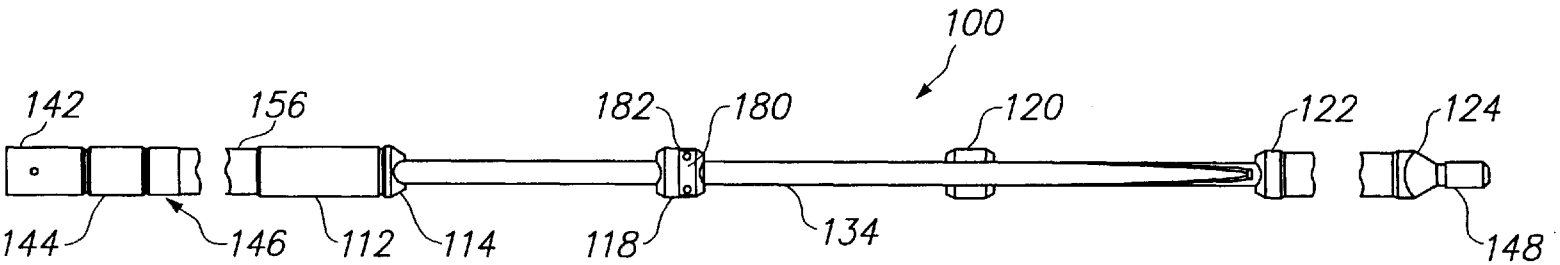
FIG. 4 is a top view of the drilling assembly of FIG. 2.

FIG. 4 is a top view of the drilling assembly 100 of FIG. 2 showing the cement collars 142, 144, and 146. The cement collars 142, 144, and 146 will generally include a stage cement collar 142, float collar 144, and cement collar 146 for the cementing of the drilling assembly 100 into the wellbore 12. The cement collar 146 is connected to a tubular support 156 which attaches to the first end 102 of the drilling assembly 100 and the threaded cylinder 112. The tubular support 156 is attached to the drilling assembly 100 to separate the first end 102 of the drilling assembly from the cement collar 146.

As shown in FIG. 1, the drilling assembly 100 is attached to a casing string 20 and lowered into the wellbore 12. Once the drilling assembly 100 is located at the desired depth, the drilling assembly 100 is cemented into the wellbore 12 with the casing string 20. At the second end 104 of the drilling assembly 100 as shown in FIG. 4, a cement shoe 148 is located to cover the first leg 130.

The isolation adapter 118, includes a removable plate 180 and at least two screws 182 to attach the removable plate to the isolation adapter. The removable plate 180 covers a drillable plug made of Phenolic, Teflon, aluminum, rubber or any type of plastic.

Figure 5:
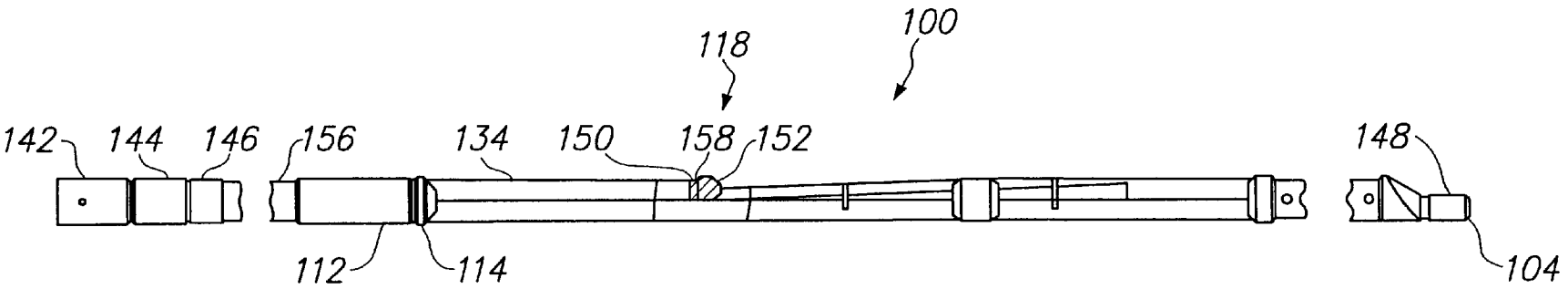
FIG. 5 is a front side view of the drilling assembly of FIG. 2 with the isolation adapter removed.

FIG. 5 is an elevation view of the drilling assembly 100 of FIG. 2 showing one embodiment of the isolation adapter 118 which has an o-ring 158 with an aluminum plug 150 and Teflon plug 152 to isolate the second leg 134 from the first leg 130. The aluminum plug 150 and Teflon plug 152 are installed before the drilling assembly 100 is lowered into the wellbore. Once the drilling assembly 100 has been cemented into the wellbore, and the first leg 130 has been drilled, the second leg 134 will be drilled out through the aluminum plug 150 and Teflon plug 152 into the second wellbore. The isolation adapter 118 will be described in further detail below with respect to FIGS. 13–16. FIG. 5 also depicts the cement shoe 148 located at the second end 104 of the drilling assembly 100 located on the first leg 130.

Figure 6:
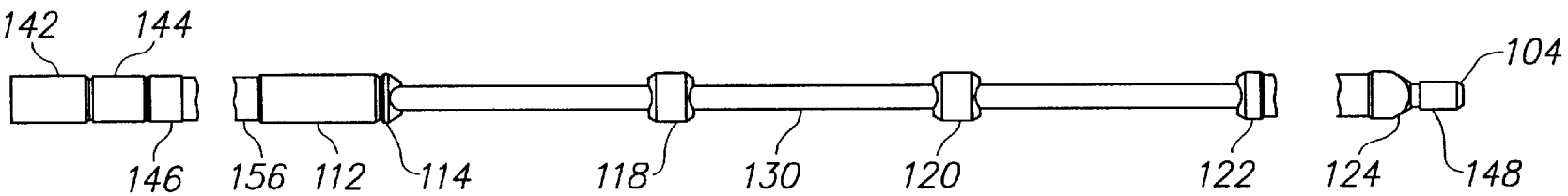
FIG. 6 is a bottom view of the drilling assembly of FIG. 2.

FIG. 6 is an elevation view of the drilling assembly 100 of FIG. 2 depicting the first leg 130.

Figure 7:
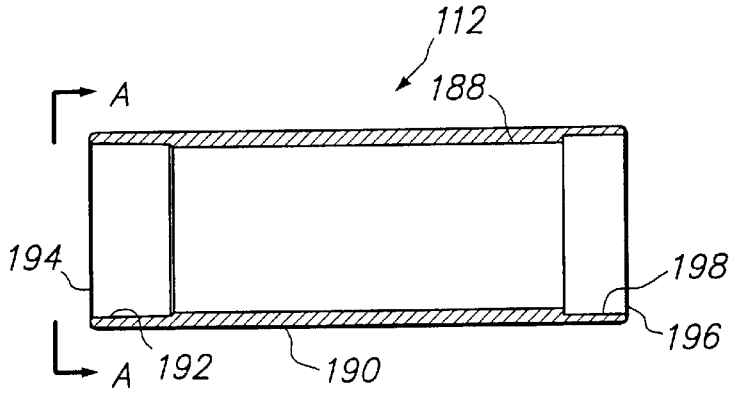
FIG. 7 is a cross-sectional view of the threaded cylinder of the drilling assembly.

FIG. 7 is a cross-sectional view of the threaded cylinder 112 of the drilling assembly 100. The threaded cylinder 112 is located at the first end 102 and connects to a casing string, surface casing or intermediate casing by a tubular support 156 (or pup joint) and a series of cement collars including a stage cementing collar 142, float collar 144, and cement collar 146. The adapter 160 is contained within the threaded cylinder 112. In addition, the threaded cylinder 112 is designed to accommodate a removable guide 200.

As shown in FIG. 7, the threaded cylinder 112 is a cylinder having a first end 194 and a second end 196. The first end 194 is connected to the casing string by the series of cement collars. The threaded cylinder 112 has an outside diameter 190 with a first inner diameter 192, a smaller second inner diameter 188, and a third inner diameter 198. The first inner diameter 192 is threaded, such as with a buttress thread to connect the drilling assembly 100 to the casing string or cement collars. However, the first inner diameter 192 can be any type of thread that meets API (American Petroleum Institute) standards including a long thread and couple, or a short thread and couple. Alternatively, any proprietary thread can be used for the thread on the first inner diameter 192 of the threaded cylinder 112.

The removable guide 200 (FIG. 20) is positioned between the first end 194 and the second end 196, and is configured to engage the adapter 160 (FIG. 9) for selecting one of two bore holes to be drilled.

Figure 8:
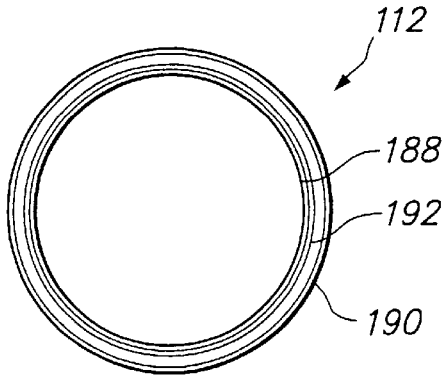
FIG. 8 is an end view of the threaded cylinder taken along the line A—A of FIG. 7.

FIG. 8 is an end view of the threaded cylinder 112 taken along the line A—A of FIG. 7.

Figure 9:
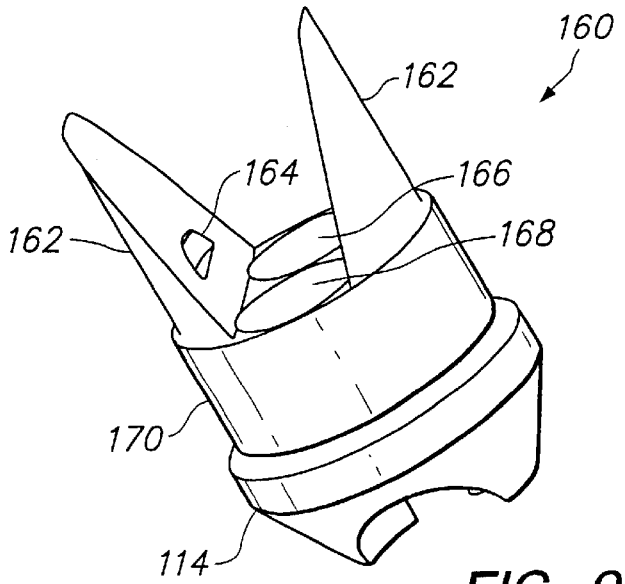
FIG. 9 is a perspective view of an adapter.

FIG. 9 is a perspective view of an adapter 160 which is fixed in the threaded cylinder 112 for receiving the removable selector guide 200. The adapter 160 has two side supports 162 with orientation slots 164 positioned on the inside thereof. The orientation slots 164 are designed to accept the removable guide 200. The side supports 162 are attached to a base 170 which has two bore holes 166, 168 there through. The base 170 is attached to the receiver guide 114. The side supports 162, orientation slots 164, first bore hole 166, second bore hole 168 and base 170 are contained within the threaded cylinder 112. The receiver guide 114 is exposed to the wellbore.

Figure 10:
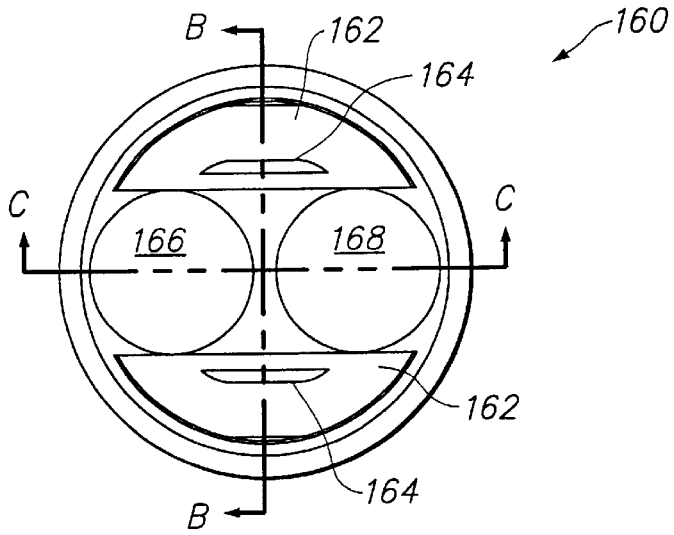
FIG. 10 is a top view of the adapter of FIG. 9.

FIG. 10 is a plan view of the top of the adapter 160 of FIG. 9 showing the side supports 162, orientation slots 164, and first and second bore holes 166 and 168, respectively.

Figure 11:
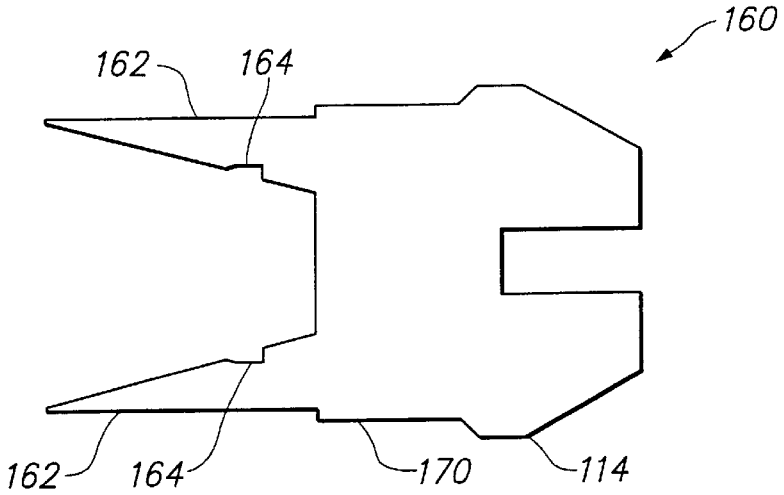
FIG. 11 is a cross-sectional view of the adapter taken along the line B—B of FIG. 10.

FIG. 11 is a cross-sectional view of the adapter 160 taken along the line B—B of FIG. 10. FIG. 11 shows the side support 162, orientation slots 164, base 170, and receiver guide 114.

Figure 12:
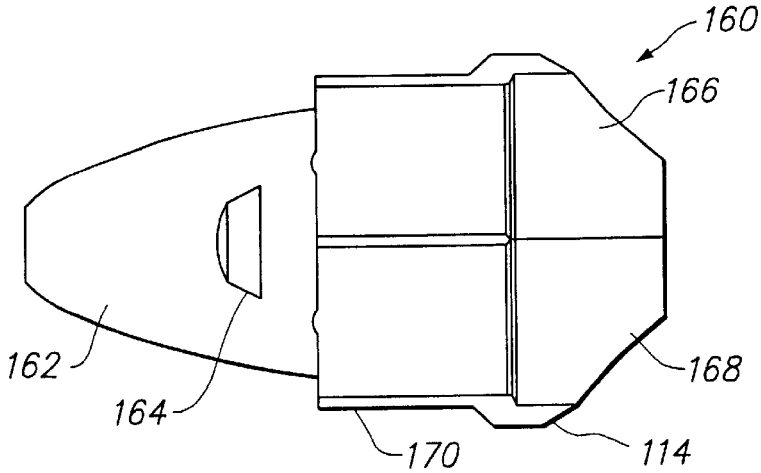
FIG. 12 is a cross-sectional view of the adapter taken along the line C—C of FIG. 10.

FIG. 12 is a cross-sectional view of the adapter 160 taken along the line C—C of FIG. 10. The side supports 162, orientation slots 164, base 170, receiver guide 114, and the two bore holes 166 and 168 are shown.

Figure 13:
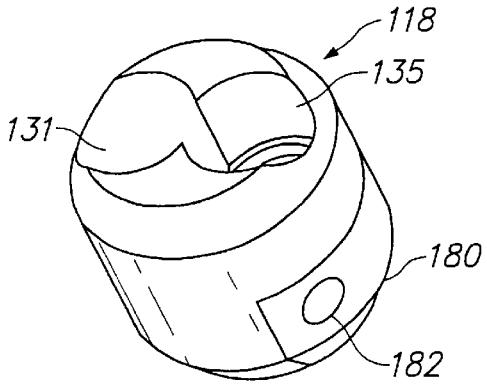
FIG. 13 is a perspective view of an isolation adapter of the drilling assembly.

FIG. 13 is a perspective of an isolation adapter 118 of the drilling assembly 100. The isolation adapter 118 is located between the receiver guide 114, and upper centralizer body 120. The second leg 134 begins to deviate from the first leg 130 at the isolation adapter 118. The isolation adapter 118 has a first bore hole 131 for the first leg 130, a second bore hole 135 for the second leg 134, and a removable plate 180. The removable plate 180 is attached to the isolation adapter 118 by at least two screws 182. The removable plate 180 allows insertion of and secures the aluminum plug 150 shown in FIG. 5, which prevents cement from entering the drilling assembly 100. On the end of the removable plate 180, the Teflon plug 152 is also installed to protect the drilling assembly 100 during cementing operations.

Figure 14:
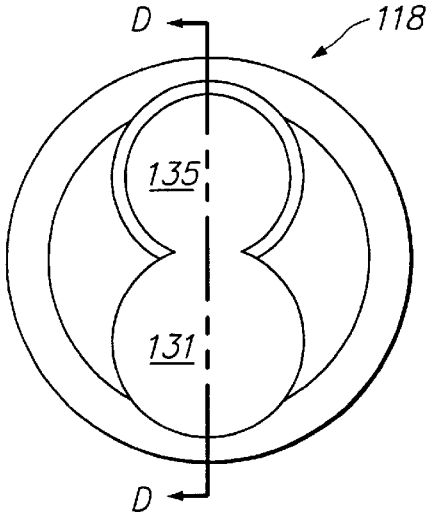
FIG. 14 is a top view of the isolation adapter of FIG. 13.

FIG. 14 is a plan view of the top of the isolation adapter 118 of FIG. 13. The isolation adapter 118 has two bore holes 131, 135 for the first leg 130 and second leg 134, respectively.

Figure 15:
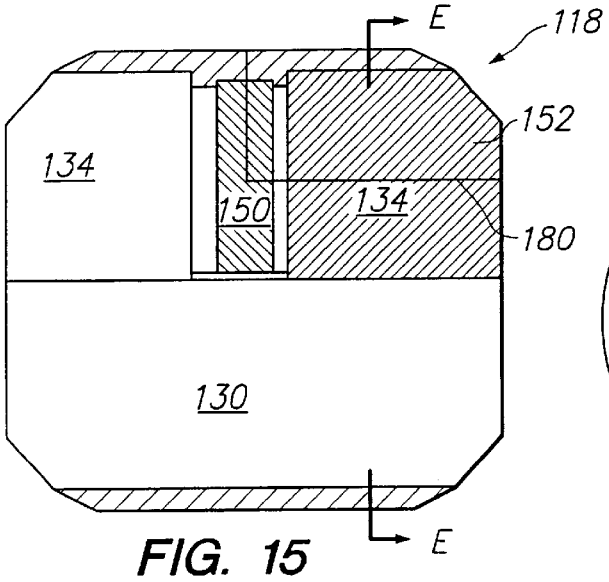
FIG. 15 is a cross-sectional view of the isolation adapter taken along the line D—D of FIG. 14.

FIG. 15 is a cross-sectional view of the isolation adapter 118 of FIG. 13. FIG. 15 depicts the first leg 130 and second leg 134 of the drilling assembly 100 as the legs intersect the isolation adapter 118. In addition, the removable plate 180 is also depicted.

Figure 16:
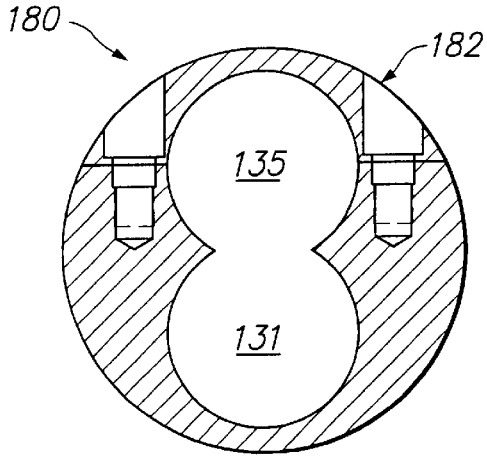
FIG. 16 is a cross-sectional view of the isolation adapter taken along the line E—E of FIG. 15.

FIG. 16 is a cross-sectional view of the isolation adapter 118 taken along the line E—E of FIG. 13. The figure depicts the bore holes 131, 135 for the first leg 130 and second leg 134 as well as the screw holes 182 for securing the removable plate 180.

Figure 17:
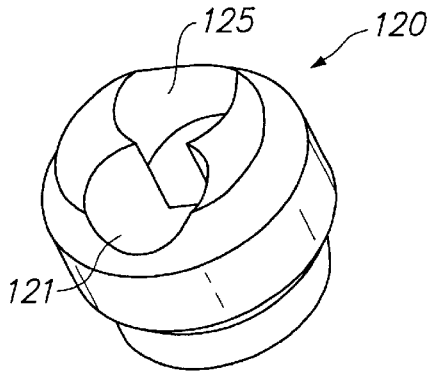
FIG. 17 is a perspective view of an upper centralizer body.

FIG. 17 is a perspective view of an upper centralizer body 120. The upper centralizer body 120 is located between the isolation adapter 118, and the second end 104 of the drilling assembly 100. The upper centralizer body 120 has two bore holes 121 and 125 for securing the first leg 130 and second leg 134 of the drilling assembly 100. The upper centralizer body 120 supports the drilling assembly 100 as it is lowered into the wellbore.

Figure 18:
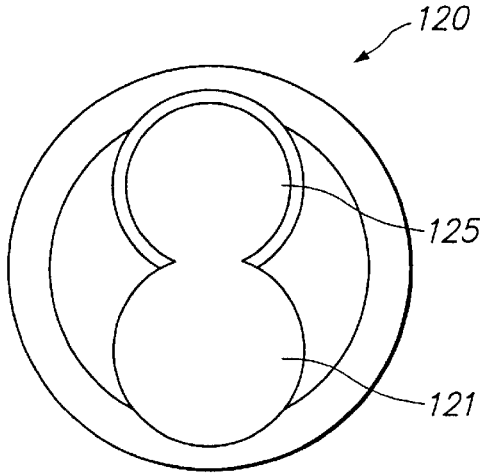
FIG. 18 is a top view of the upper centralizer body of FIG. 17.

FIG. 18 is a top view of the upper centralizer body 120 of FIG. 17. The bore holes 121, 125 of the first leg 130 and second leg 134 are shown.

Figure 19:
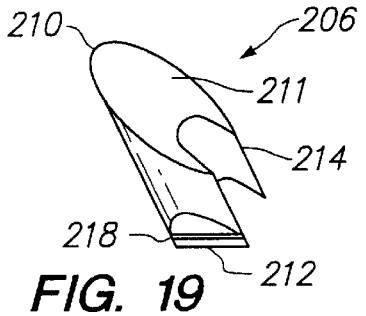
FIG. 19 is a perspective view of an angled guide portion of a removable guide.
Figure 20:
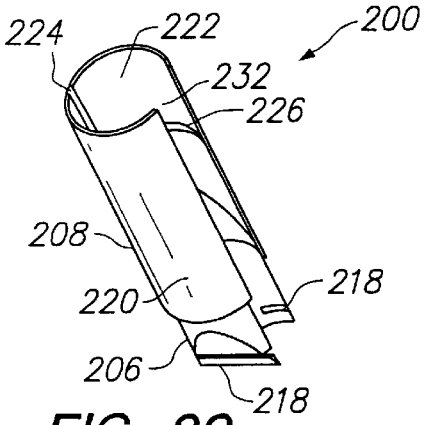
FIG. 20 is a perspective view of a removable guide.

FIG. 19 is a perspective view of an angled guide member 206 which forms a part of the removable guide 200 of FIG. 20. The angled guide member 206 has a substantially cylindrical body 214, having a first end 210 and a second end 212. The first end 210 has an angled surface 211 to direct a drill bit into one of the legs. The second end 212 has two angled side surfaces and members 218 configured to engage the adapter 160.

FIG. 20 is a perspective view of the removable guide 200 including a cylindrical body 208 surrounding the angled guide member 206. The cylindrical body 208 has an outer diameter 220 and an inner diameter 222. The inner diameter 222 has a first slot 224 for accepting a first lug 318 of a latching tool 300 (FIG. 27), and a second slot 226 for the latching tool to latch into the removable guide 200. The cylindrical body 208 also has an open side, which forms a wide third slot 232, for accepting the second lug 328 of the latching tool 300.

Figure 21:
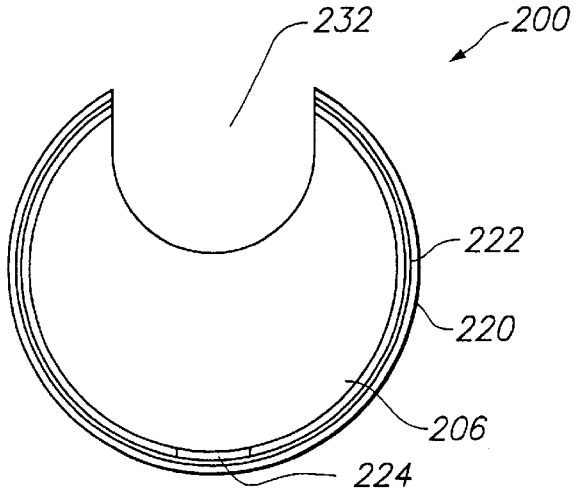
FIG. 21 is a top view of the removable guide of FIG. 20.

FIG. 21 is a top view of the removable guide of FIG. 20.

Figure 22:
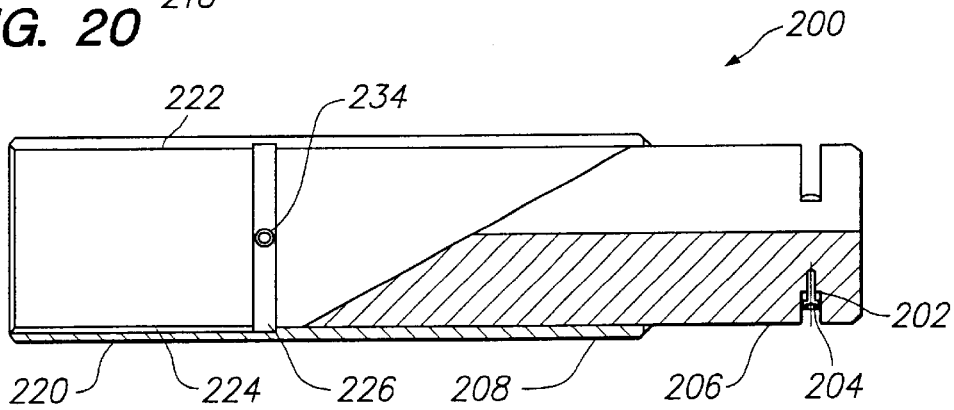
FIG. 22 is a cross-sectional view of the removable guide of FIG. 20.

FIG. 22 is a cross-sectional view of the removable guide 200 of FIG. 20. FIG. 22 depicts the outer diameter 220, the inner diameter 222, the first slot 224 for accepting the latching tool 300, and the second slot 226 for latching into the removable guide 200. In the second slot 226, a stop 234 prevents the first lug 318 and second lug 328 of the latching tool 300 from rotating beyond a certain point within the second slot. Also depicted is the angled guide member guide 206, including a c-ring 202, and a threaded fastener 204 for engaging the adapter 160. Although the removable guide 200 has been illustrated to be formed by joining the angled guide member 206 and the cylindrical body 208, the removable guide may also be formed as one piece.

Figure 23:
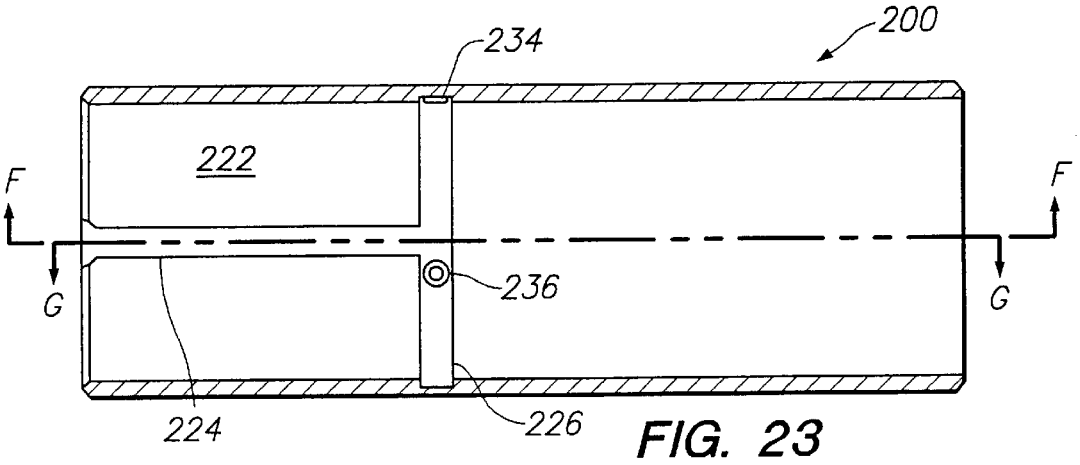
FIG. 23 is a cross-sectional view of the cylindrical body of FIG. 20.
Figure 24:
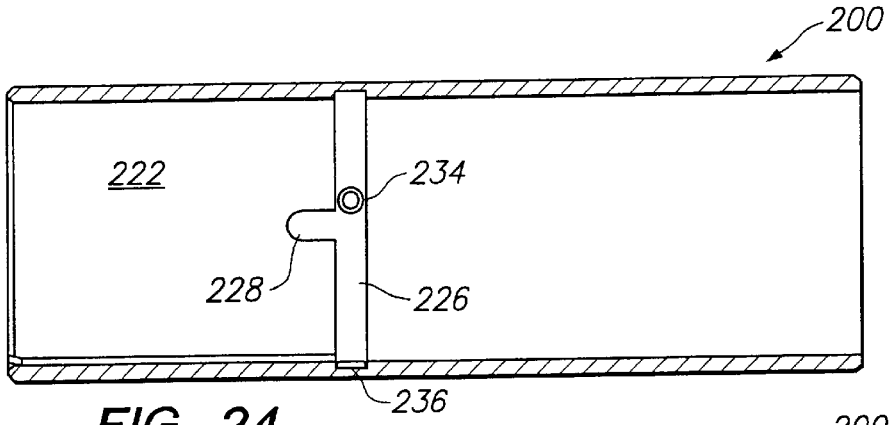
FIG. 24 is a cross-sectional view of the cylindrical body of FIG. 20 taken along the line F—F of FIG. 23.
Figure 25:
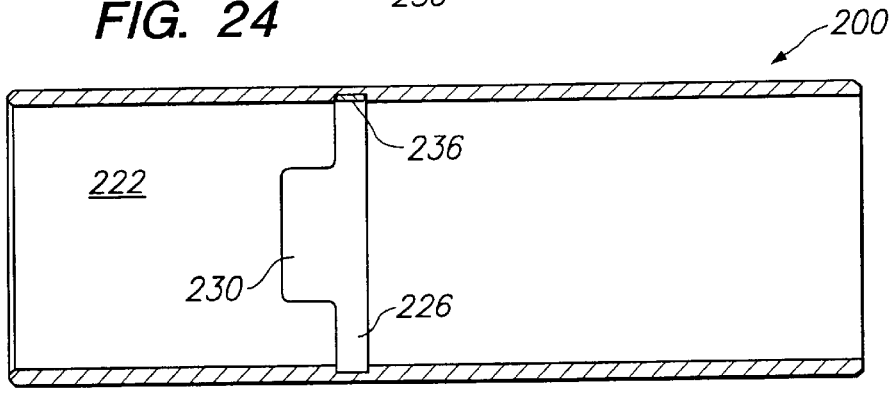
FIG. 25 is a cross-sectional view of the cylindrical body of FIG. 20 taken along the line G—G of FIG. 23.

FIGS. 23–25 are cross-sectional views of the inner diameter 222 of the cylindrical body 208 and the first slot 224 for accepting the latching tool 300. The first lug 318 (FIG. 28) of the latching tool 300 is lowered into the cylindrical body 208 through the first slot 224 of the removable guide 200. The first lug 318 of the latching tool 300 will ride on top of the removable guide 200 until proper orientation is achieved. If the first lug 318 is positioned correctly, the first slot 224 will accept the first lug. If not, the drill string is slowly rotated until the first lug 318 is positioned in the first slot 224.

The second lug 328 of the latching tool 300 engages the open end or third slot 232 of the removable guide 200. As with the first lug 318, the second lug 328 will ride on top of the removable guide 200 until proper orientation is achieved. If the second lug 328 is positioned correctly, the wide third slot 232 or open side of the cylinder will accept the second lug 328.

The first lug 318, and second lug 328 are then lowered simultaneously through the first slot 224, and third slot 232, respectively, into the second slot 226. The second lug 328 is larger than the first lug 318 so that the first lug 318 and second lug 328 can only be accepted by slots 224 and 232, respectively.

After placing the first lug 318 in the second slot 226, the second lug 328 in the third slot 232, the drill string is rotated clockwise, at which time the first lug 318 and a second lug 328 will engage the inner slots 228, 230 as shown in FIGS. 24 and 25, respectively. The second slot 226 has two stops 234, 236, for directing the lugs 318, 328 into the inner slots 228, 230.

The drill string, including the latching tool 300 and removable guide 200 is then picked up, rotated 180 degrees, and lowered into the adapter 160. Once the removable guide 200 has been placed into the adapter 160, the latching tool 300 is rotated counterclockwise, which releases the removable guide 200 from the latching tool 300. The latching tool 300 is then removed from the wellbore.

Figure 26:
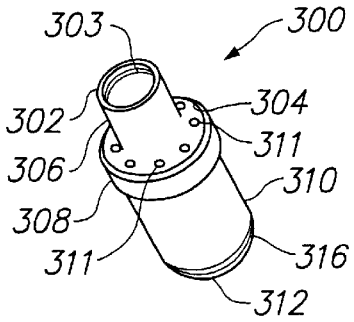
FIG. 26 is a perspective view of a latching tool.

FIG. 26 is a perspective view of a latching tool 300. The latching tool 300 has a first end 302 and a second end 312, the first end 302 having a series of threads 303 to attach to a drilling string, and the second end 312 with a first lug 318 (FIG. 28) and a second lug 328 (FIG. 28) configured to engage the slots 224, 226, 228, and 230 on the inner diameter 222 of the cylindrical body 208 of the removable guide 200. The latching tool 300 includes a first cylinder 306 with a first diameter, and a second cylinder 310 with a second diameter. The first cylinder 306 is attached to a collar 308, which is attach to the second cylinder 310 and a base plate 316. The collar 308 has an annular surface 304 with a plurality of tubes 342 extending from the holes 311 to the base plate 316. The tubes 342 exit at the base plate 316 through a series of holes 344.

Figure 27:
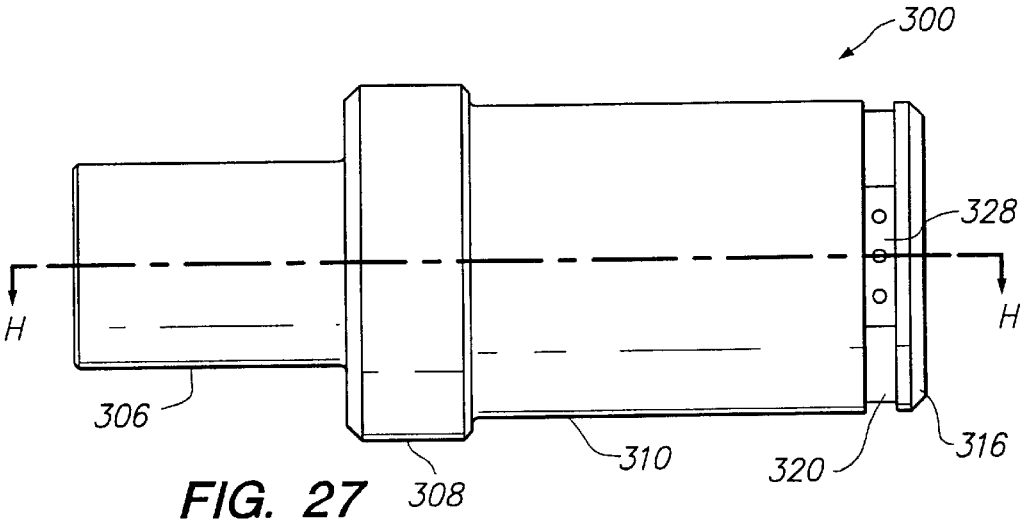
FIG. 27 is a side view of the latching tool of FIG. 26.

FIG. 27 is a side view of the latching tool of FIG. 26. FIG. 27 depicts the first cylinder 306, collar 308, and second cylinder 310. At the bottom of the latching tool 300, a narrow tubular body 320 is connected to the base plate 316. The first lug 318 and the second lug 328 are welded onto the narrow tubular body 320.

Figure 28:
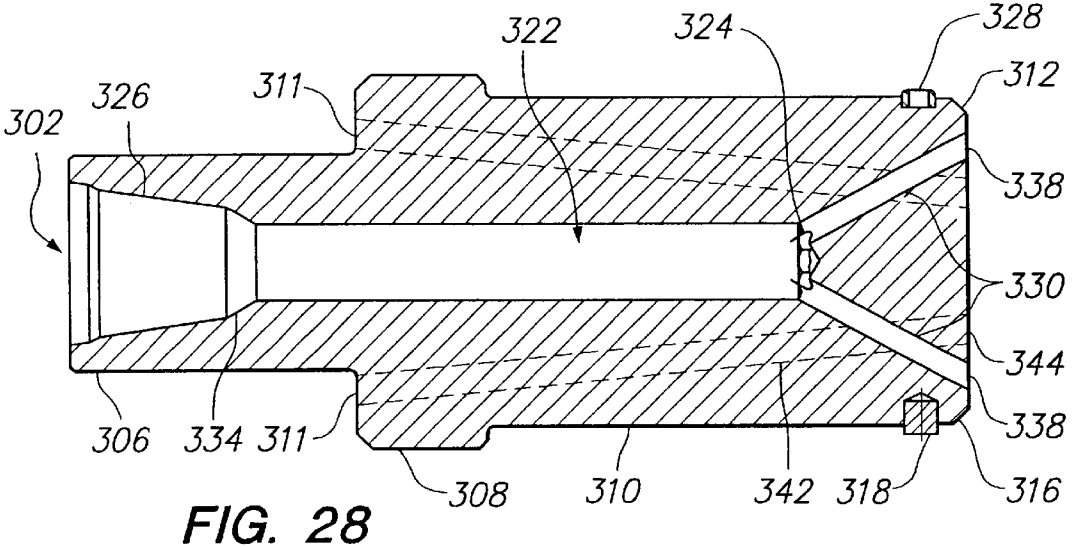
FIG. 28 is a cross-sectional view of the latching tool taken along the line H—H of FIG. 27.

FIG. 28 is a cross-sectional view of the latching tool 300 taken along the line F—F of FIG. 27. The inside of the latching tool 300 has a series of threads 326, a first tube 334, a second tube 322 and a diverter 324. The diverter 324 is connected to a plurality of tubes 330. The tubes 330 extend from the diverter 324 to the base plate 316 of the latching tool 300 and exit at the base plate through a series of holes 338. On the outside of the second cylinder 310 near the base plate 316, the first lug 318 and the second lug 328 are welded onto the latching tool 300 and configured to engage the inner diameter 222 of the removable guide 200 and slots 224, 226, 228, 230 and 232.

As shown in FIG. 28, the second tube 322 of the latching tool 300 extends from the first end 302 to the second end 304. The tube has a plurality of tubes 330 which exit through a plurality of holes 338 on the base plate 316 of the latching tool 300. The holes 338 are sized to create a fluid pressure pulse for use with conventional directional measurement equipment, and to clean the adapter 160 as the latching tool 300 is run into the hole.

Figure 29:
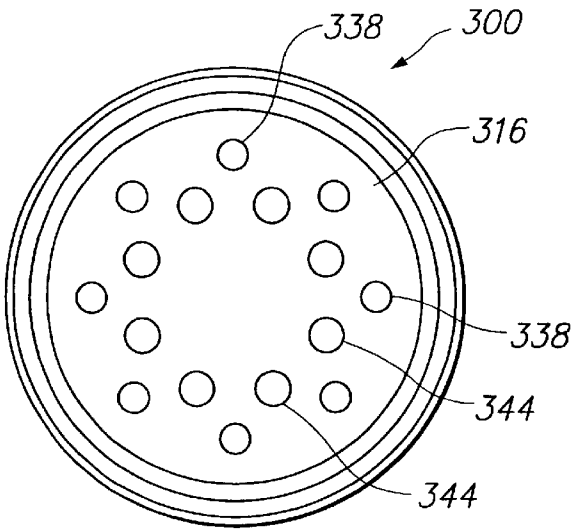
FIG. 29 is a bottom view of the latching tool of FIG. 26.

FIG. 29 is a bottom view of the base plate 316 of the latching tool 300 of FIG. 26. The base plate 316 has a plurality of holes 338 and 344 for fluid to enter and exit the latching tool 300.

In one embodiment, as illustrated in FIGS. 2–6, the first leg 130 extends from the adapter 160 to the second end 104, and the second leg 134 extends from the adapter 160 to a side exit 136 between the adapter 160 and the second end 104.

Figure 30:
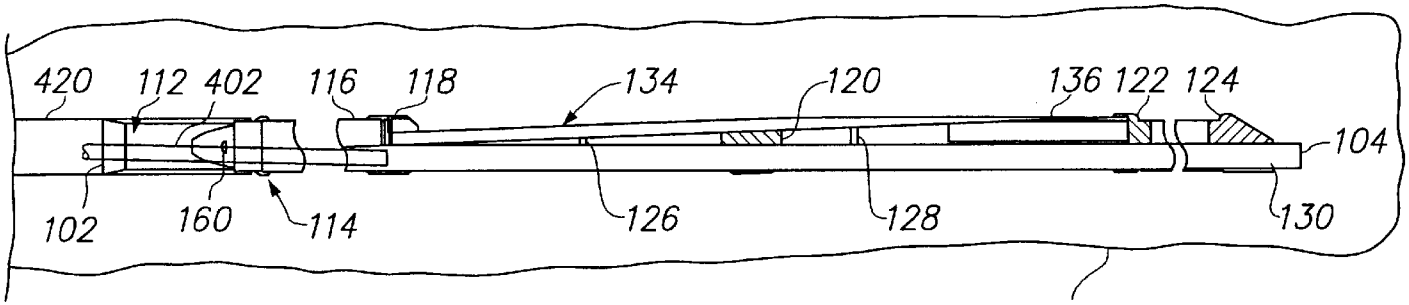
FIG. 30 is cross-sectional view of the drilling assembly with a tube for cementing operations.

In a further embodiment as shown in FIG. 30, the drilling assembly 100 is connected directly to a casing string 420 rather than to a stage cementing collar, float collar, cement collar, and tubular support. In this embodiment, the drilling assembly 100 is cemented into the wellbore 412 by the use of a tube 402 which is run in the drilling assembly. The tube 402 extends below the adapter 160 and is made of a material, such as phenolic, Teflon, aluminum, rubber or any type of plastic, which can be drilled out by a drill bit once the cementing of the drilling assembly is complete. The drilling assembly 100 is cemented into the wellbore 412 by pumping cement through the inside of the casing string 420 into the tube 402. The cement is then pumped through the tube 402, into long leg 130 of the drilling assembly 100, and out into the wellbore 412.

In another embodiment of the drilling assembly 100 as shown in FIGS. 9–12, the drilling assembly has a self-aligning feature, such that the use of the removable guide 200 is not necessary if selecting a specific bore hole is not required. As the drill bit is lowered into the drilling assembly, the side supports 162 of the adapter 160 direct the drill bit into one of the two bore holes 166, 168. The self-aligning feature utilizes the adapter 160 and the design thereof to direct the drill bit, rather than the removable guide 200.

In a further embodiment, a method of use of the drilling assembly as shown in FIGS. 1–29 includes the steps of drilling a hole to a desired depth, positioning the drilling assembly 100 in the hole, and positioning the removable guide 200 in the drilling assembly for directing the drill bit into a first leg 130 of the drilling assembly. The drilling assembly 100 is secured to a casing string 20 and cemented into the wellbore 12. At that point the first of at least one wellbore 14 is drilled through the first leg 130 of the drilling assembly 100 to the desired depth.

The drill bit is then removed from the wellbore 12 and the latching tool 300 is run into the wellbore. The latching tool 300 latches the removable guide 200 by means of engagement of the lugs 318 and 328 in the slots 224, 226, 228, and 230 on the removable guide.

The alignment of the removable guide 200 is obtained by rotating the latching tool 300. Once latched, a conventional directional drilling measurement may be made while the drilling tool is used to determine the orientation of the removable guide 200. The removable guide 200 is released from the drilling assembly 100 by picking up the drill string. The removable guide 200 is picked up above the drilling assembly 100 and rotated about 180 degrees and replaced in the drilling assembly. The latching tool 300 is then removed from the wellbore, and a drill string is run back into the wellbore. At that point, the second wellbore is drilled to a desired depth through the second leg 134 of the drilling assembly 100. The drill bit is removed from the well, and the removable guide 200 is recovered from the drilling assembly 100 using the latching tool 300. After the removable guide has been removed, two strings of production liner and tubing are run into the well, one after another. The self-aligning feature on the drilling assembly 100 ensures the two strings each enter a different leg 130, 134 on the drilling assembly.

In another embodiment, a method of use of the drilling assembly as shown in FIGS. 1–29 includes the steps of drilling a hole to a desired depth. The drilling assembly 100 is secured to a casing string 20 and cemented into the wellbore 12. At that point the first of at least one wellbore 14 is drilled through one of the two legs 130, 134 of the drilling assembly 100 to the desired depth. After removing the drill bit, a string of production liner and tubing are run into the well and cemented. The top of the cement is left immediately below the drilling assembly 100. A second wellbore is then drilled through the other leg to the desired depth, as the production liner and tubing prevents the drill bit from going into the leg which has already been drilled. In this embodiment, the use of the removable guide 200 is not necessary as a result of the self-aligning feature of the drilling assembly 100.

The drilling process and specifics can be further understood based upon the following example:

A 20" surface structural pipe is drilled to sufficient depth to provide structural support. Thereafter, a 17½" hole is drilled to a sufficient depth below the base of the surface fresh water bearing formations to provide isolation. For this case, an arbitrary depth of 4,000 feet has been chosen. A drilling assembly for use with 13⅜" casing is attached to a string of 13⅜" casing. A 13⅜" float collar is installed between the drilling assembly and the 13⅜" casing. Sufficient joints of 13⅜" casing are run above the float collar to locate the base of the drilling assembly at the total depth of 4,000 feet.

Cement is then pumped down the 13⅜" casing out of the cement ports on the drilling assembly and placed in the annulus between the 13⅜" casing and the 17½" hole. The cement is allowed to harden. A 12¼" drill bit is then used to drill out the float collar, any cement left in the 13⅜" casing and the top drillable plug on the drilling assembly. The 12¼" drill bit is removed from the well.

A 6" drill bit is then run into the well to the drilling assembly. The removable guide in the drilling assembly directs the 6" drill bit into the first of the legs through the adapter. A 6" hole is drilled to a selected point in the target reservoir rock using conventional directional drilling equipment. The 6" drill bit is removed from the well. The latching tool is run into the well on the end of a drill string. The latching tool latches the removable guide by means of the orientation slots on the inner diameter of the removable guide. The orientation slots can be latched only when the latching tool is aligned in one specific orientation. The orientation is achieved by rotating the latching tool. Once latched, conventional directional drilling measurement equipment is used to determine the orientation of the removable guide. The removable guide is released from the drilling assembly with straight tension. The release tension is adjusted at the surface prior to installation.

The latching tool latches into the removable guide about one foot below the top of the guide. The lugs of the latching tool will ride on top of the removable guide until proper orientation is achieved. If the lugs are positioned correctly, the lugs will be lowered into the second slot. If not, the drill string is slowly rotated until the latching tool drops into the removable guide.

After placing the latching tool in the proper orientation, the drill string is rotated ½ turn or 180 degrees clockwise at which time the lugs will engage the slots of the removable guide. The drill string is then picked up and rotated 180 degrees, and then lowered into the adapter. Once the removable guide has been replaced, the latching tool is rotated ½ turn counterclockwise to release the latching tool from the removable guide. The latching tool is removed from the wellbore, and the second wellbore is ready to be drilled.

A 6" drill bit is then run into the well to the drilling assembly. The removable guide directs the drill bit into the second leg. A second wellbore is drilled to a different point in the target reservoir rock using conventional directional drilling equipment. The drill bit is removed from the well, and the removable guide is recovered from the drilling assembly using the latching tool and recovered to the surface.

Two strings of production liner and tubing are run into the well, one after another. The self-aligning feature on the drilling assembly ensures the two strings each enter a different leg on the drilling assembly. Once the end of the first production liner exits the drilling assembly, a gyro survey can be run to determine which of the two wellbores the liner has entered, should this be desired.

Both strings of production liner and tubing are run to the total depth of each wellbore leg. A conventionally available hydraulic pressure set liner hanger or production packer is positioned across the seal bore areas in the drilling assembly. Cement is pumped down both the production liner and tubing strings, one after another. The top of the cement in the production liner by bore hole annulus is left at the drilling assembly when displacing the cement on the first of the two production liner cement jobs. The cement can be circulated to surface on the second production liner or left at the drilling assembly. The hydraulic set packers are energized after the cement is placed in the annuli. The wells are now ready to install surface production equipment.

In an alternative embodiment, a movable guide does not have to be used or the guide can be completely removed after drilling the first wellbore leg. At this point, the first of the two production liners are run into the well. The liners are run on a hydraulic set liner hanger or production packer. The liner is cemented and the top of the cement left immediately below the drilling assembly. Again, the production packer and liner hanger are energized after the cement job. The top of the liner is left in the seal bore area of the drilling assembly. A conventionally available removable plug is installed on the top of the liner hanger or production packer with the top of the plug in the self-alignment area of the drilling assembly. The second wellbore leg is drilled. The self-alignment nature of the drilling assembly and the plug will direct the drill bit into the second leg of the drilling assembly. The procedure to drill the second wellbore leg and install the second production liner is the same as if the removable guide had been used.

In a further embodiment, the first leg is drilled through the long leg of the drilling assembly. The removable guide is removed from the wellbore and the first of the two production liners are run into the well. The liners are run on a hydraulic set liner hanger or production packer. The liner is cemented and the top of the cement left immediately below the drilling assembly. Again, the production packer and liner hanger are energized after the cement job. The top of the liner is left in the seal bore area of the drilling assembly. The removable guide is then placed back into the drilling assembly. The drill bit is run back into the hole and the second leg of the drilling assembly is drilled and completed.

While the invention has been described in detail with reference to the preferred embodiments thereof, it will be apparent to one skilled in the art that various changes and modifications can be made and equivalents employed, without departing from the present invention. For Example, the drilling assembly with removable guide may be made with only an inclined leg or with no legs extending from the adapter.

What is claimed is:

1. An apparatus for use in drilling oil and gas production wells or water injection wells with a drill string including a drill bit, the apparatus comprising:

a hollow body for receiving a drill bit;

an adapter cooperatively joined to the hollow body;

at least two tubes forming a first leg for drilling a first bore hole and a second leg for drilling a second bore hole, the at least two tubes having exits and extending from at least one of the hollow body and adapter to respective distal ends with the exits being sufficiently spaced and directed apart such that the first and second bore holes may be drilled there through without having to first complete one of the bore holes; and a removable guide positioned within at least one of the hollow body and adapter to direct a drill bit into one of the legs and being configured to engage the adapter in two positions for directing a drill bit into one of the legs.

2. The apparatus of claim 1, wherein the apparatus has a self-aligning feature such that the use of the removable guide is not necessary if selecting a specific leg is not required.

3. The apparatus according to claim 1, wherein the second leg is at an angle of between about 0 to about 4 degrees with respect to the first leg.

4. The apparatus according to claim 1, wherein the apparatus has at least one collar for guiding the apparatus down the wellbore.

5. The apparatus according to claim 1, wherein the apparatus has a plurality of collars for guiding the drilling assembly down the wellbore.

6. The apparatus of claim 1, wherein the hollow body is attached relative to a casing string.

7. The apparatus of claim 1, wherein the hollow body is attached relative to a surface casing string.

8. The apparatus of claim 1, wherein the hollow body is attached relative to an intermediate casing string.

9. The apparatus according to claim 1, wherein the adapter has an orientation slot for orienting the removable guide.

10. The apparatus according to claim 1, wherein the adapter has a plurality of orientation slots for orienting the removable guide.

11. A system for use in drilling oil and gas production wells or water injection wells, the system comprising:

a drilling assembly having a hollow body and an adapter cooperatively joined to the hollow body;

at least two tubes extending from the adapter, the tubes forming a first leg for drilling a first bore hole and a second leg for drilling a second bore hole;

a removable guide positioned within one of the hollow body and adapter to direct a drill bit into one of the legs, and the removable guide being configured to engage the adapter in two positions for directing the drill bit into one of the legs, and the removable guide having an outside perimeter and an inside perimeter wherein the inside perimeter has at least one slot for accepting a latching tool; and a latching tool having a first end and a second end, the first end being attachable to a drilling string, and the second end configured to removably engage the slot in the removable guide.

12. The system of claim 11, wherein the latching tool has at least one bore extending there through for fluid to flow through the tool.

13. The system of claim 11, wherein the latching tool has a plurality of bores extending there through for fluid to flow through the tool.

14. A method of using a drilling assembly, the method comprising:

drilling a main wellbore to a desired depth;

installing in the main wellbore a drilling assembly including a hollow body for receiving a drill bit, an adapter cooperatively joined to the hollow body and at least a pair of first and second legs depending from at least one of the hollow body and adapter for drilling first and second wellbores;

positioning a removable guide in the drilling assembly for directing a drill bit into the first leg of the drilling assembly;

securing the drilling assembly to a casing string;

cementing the drilling assembly into the hole;

drilling a first wellbore through the first leg of the drilling assembly to a desired depth;

removing the drill bit from the wellbore after drilling the first wellbore;

running a latching tool into the main wellbore after removing the drill bit; and latching the removable guide with the latching tool by means of slots on the removable guide;

wherein alignment of the removable guide is obtained by rotating the latching tool.

15. The method of claim 14, wherein once latched, a conventional directional drilling directional measurement is used to determine the orientation of the removable guide.

16. The method of claim 15, wherein the removable guide is released from the drilling assembly.

17. The method of claim 16, wherein the removable guide is picked up above the drilling assembly with the latching tool, rotated about 180 degrees, and replaced in the drilling assembly.

18. The method of claim 17, wherein the removable latching tool is removed from the well after replacing the removable guide in the drilling assembly.

19. The method of claim 18, wherein a second wellbore is drilled to a desired depth through the drilling assembly.

20. The method of claim 14, wherein a cement staging collar, float collar, and cement collar are used to cement the drilling assembly into the wellbore.

21. The method of claim 14, wherein a tube is used to cement the drilling assembly into the wellbore.

22. The method of claims 14, wherein the drilling assembly is attached to a casing string.

23. The method of claim 14, wherein the drilling assembly is attached to a surface casing string.

24. A method of using a drilling assembly, the method comprising:

drilling a hole to a desired depth;

securing a drilling assembly having a removable guide and a first leg and a second leg to a casing string;

cementing the drilling assembly into the hole;

drilling a first wellbore through the removable guide and the first leg of the drilling assembly to a desired depth, the removable guide directing a drill bit into the first leg;

removing the removable guide from the hole; and drilling a second wellbore through the second leg of the drilling assembly to a second desired depth without the use of the removable guide to direct a drill bit into the second leg of the drilling assembly.

25. The method of claim 24, further including the step of positioning a first production liner in the first wellbore and extending from the drilling assembly into the first wellbore; and wherein the production liner prevents the drill bit from entering the first leg of the drilling assembly, thereby causing the drill bit to enter the second leg of the drilling assembly.

26. The method of claim 34 wherein:

first and second production liners are installed in the respective first and second wellbores after both the first and second wellbores have been drilled.

* * * * *